United States Patent [19]

Arias

[11] 3,960,241

[45] June 1, 1976

[54] FURNITURE FOLDABLE STRUCTURE

[75] Inventor: Anibal Aguirre Arias, Cali, Colombia

[73] Assignee: Escalesilla Tresaes Ltd., Cali, Colombia

[22] Filed: Nov. 19, 1975

[21] Appl. No.: 633,506

[52] U.S. Cl. ..... 182/33.3; 297/118

[51] Int. Cl.[2] ..... A47C 13/00

[58] Field of Search ..... 182/33, 33.2, 33.3, 182/33.4, 33.5, 33.6; 297/118, 130

[56] References Cited

UNITED STATES PATENTS

| | | | |
|---|---|---|---|
| 1,557,342 | 10/1925 | Schlamp | 182/33.3 |
| 1,937,886 | 12/1933 | Grose | 182/33 |
| 2,805,703 | 9/1957 | Wise | 182/33.5 |
| 2,998,862 | 9/1961 | Early | 182/33.2 |
| 3,058,544 | 10/1962 | Rossi | 182/33 |

*Primary Examiner*—Reinaldo P. Machado
*Attorney, Agent, or Firm*—Browdy and Neimark

[57] ABSTRACT

Furniture foldable structure, unfoldable to provide either a chair or ladder structure, which foldable structure comprises a pair of spaced front poles pivot connected at the top ends of a pair of equally spaced rear legs, said poles being connected together by a top transverse rigid member, and being angularily shiftable from said pair of rear legs; said poles are provided with intermediate means for supporting seat board sections, said board sections being pivotally connected between elongated members of a swingable frame; wherein said boards sections are comprised of a first rectangular front section and a second rectangular rear section, said first and second board sections being linked together by side swing connecting means, said first board section being upwardly and rearwardly oscillable from said intermediate supporting means to be horizontally supported on said transverse rigid member connecting the top of said pair of poles, whereby said swing connecting means bring said second rectangular rear board section to a lower parallel plane and in position forwardly shifted from said first rectangular section; said intermediate supporting means comprising an intermediate board supported on a transverse member having its ends fixedly joined to the intermediate portion of said poles and a lower board is slidingly assembled to the lower length of said pair of poles, serving such lower board as the first tread of a ladder structure.

6 Claims, 6 Drawing Figures

FURNITURE FOLDABLE STRUCTURE

This invention broadly relates to furnitures and more specifically is directed toward a furniture foldable structure which may be unfolded to either a chair structure or a stepladder structure herein below referred to as ladder structure.

In household and storehouse duties and the like there is often a need of gaining access to places located at some height which customarily is done by means of a common use ladder or the like. For the sake of space saving it would be desirable to have a structure which in a simple manner could be set up to serve as a ladder and then it could be converted into a structure for another use.

Therefore, it is the main object of this invention to provide a furniture foldable structure which in a simple manner, without the need of tools, it may be unfolded into either ladder or chair structure as desired.

The foldable furniture of the invention is comprised of a tubular frame including two poles maintained spaced apart each other by a fixed top transverse member and a fixed intermediate transverse member located just below the plane that the seat board will assume. Each of a pair of equal spaced apart legs are pivot joined to each of said poles, at points facing together, located above the height of the seat board plane. In the unfolded position of use of the structure as both chair and ladder, the pair of poles will assume an angular forward inclined position with respect to the rearward inclined legs. The structure is provided with swingable board sections to be brought to position of a chair seat or ladder treads.

BRIEF DESCRIPTION OF THE DRAWINGS

The invention will be disclosed in detail with regard to the embodiment thereof show in the drawings, in which, FIG. 1. is a perspective view of the furniture foldable structure of this invention when unfolded to the position of use as a chair.

Figure 1:
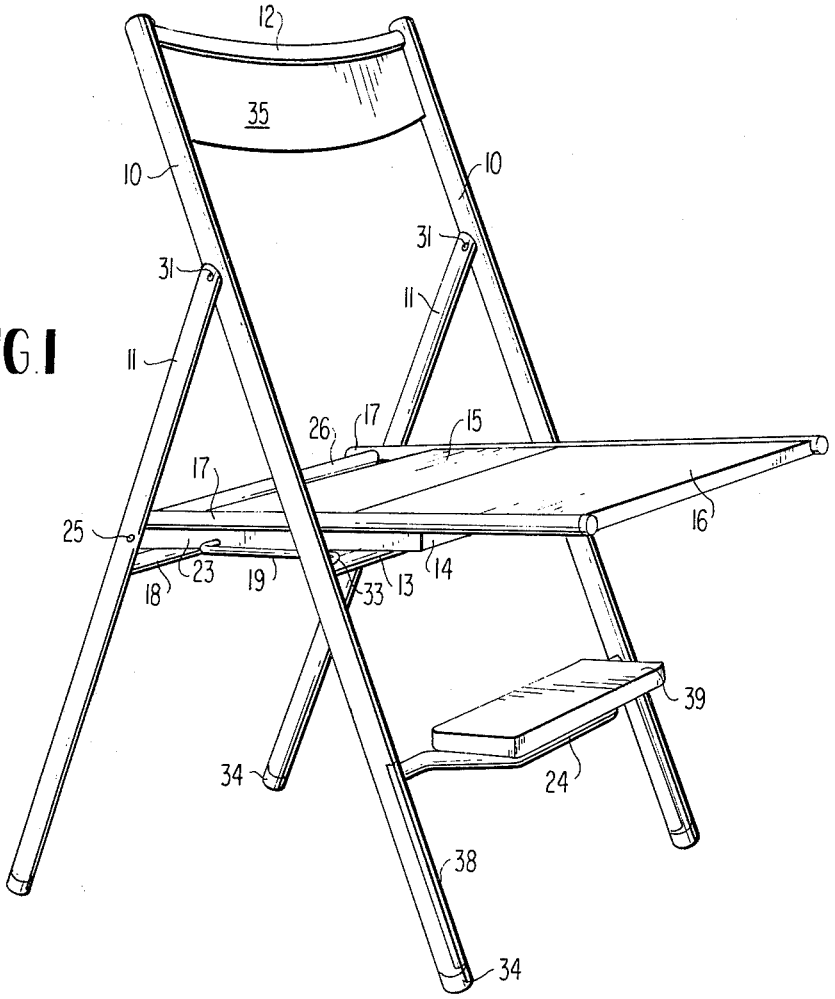
Figure 5:
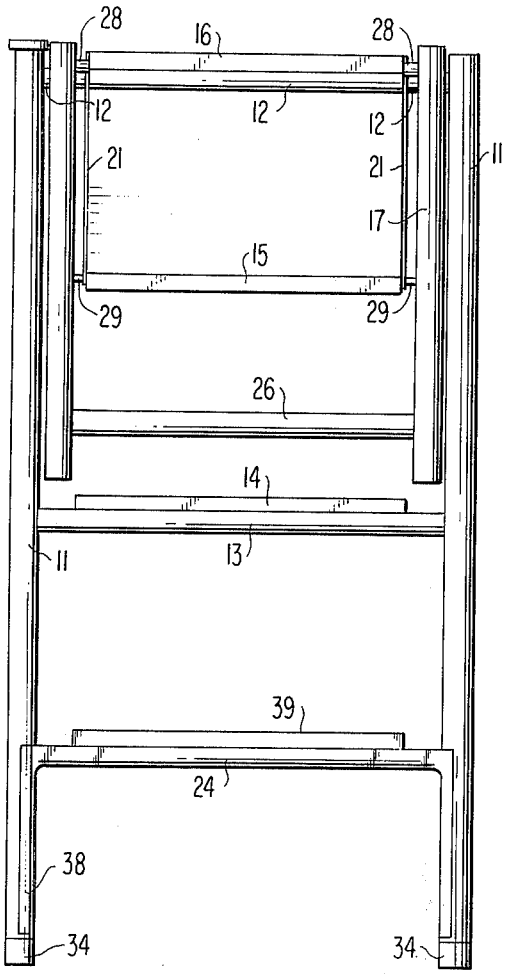
FIG. 5. is a front elevation view of the structure arranged as ladder.
Figure 2:
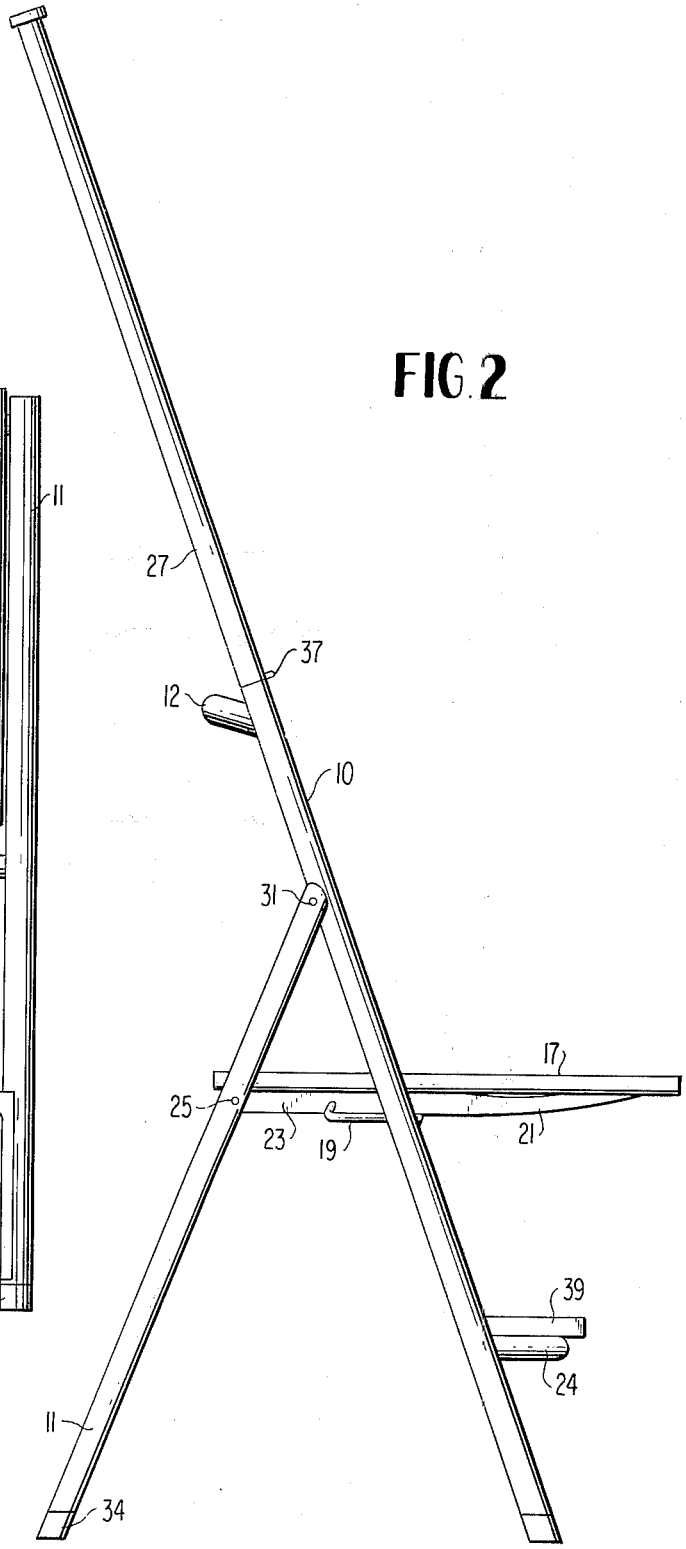
FIG. 2. is a side elevation view showing the structure of the invention unfolded to the position of use as a chair, but with a telescopic rod extended from its housing to serve as a handrail in a preparatory step to the conversion of the chair structure into ladder structure.
Figure 6:
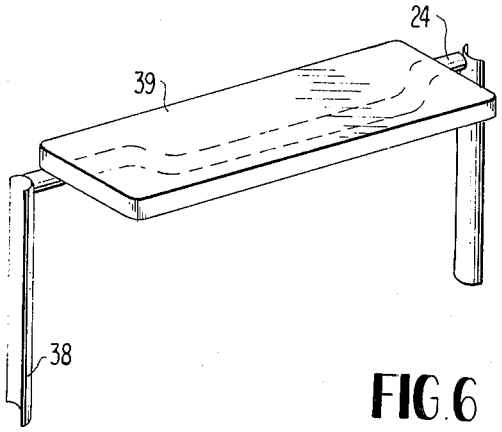
FIG. 6. is a perspective view of the removable first tread, showing the means for assembling the same to the general structure.
Figure 3:
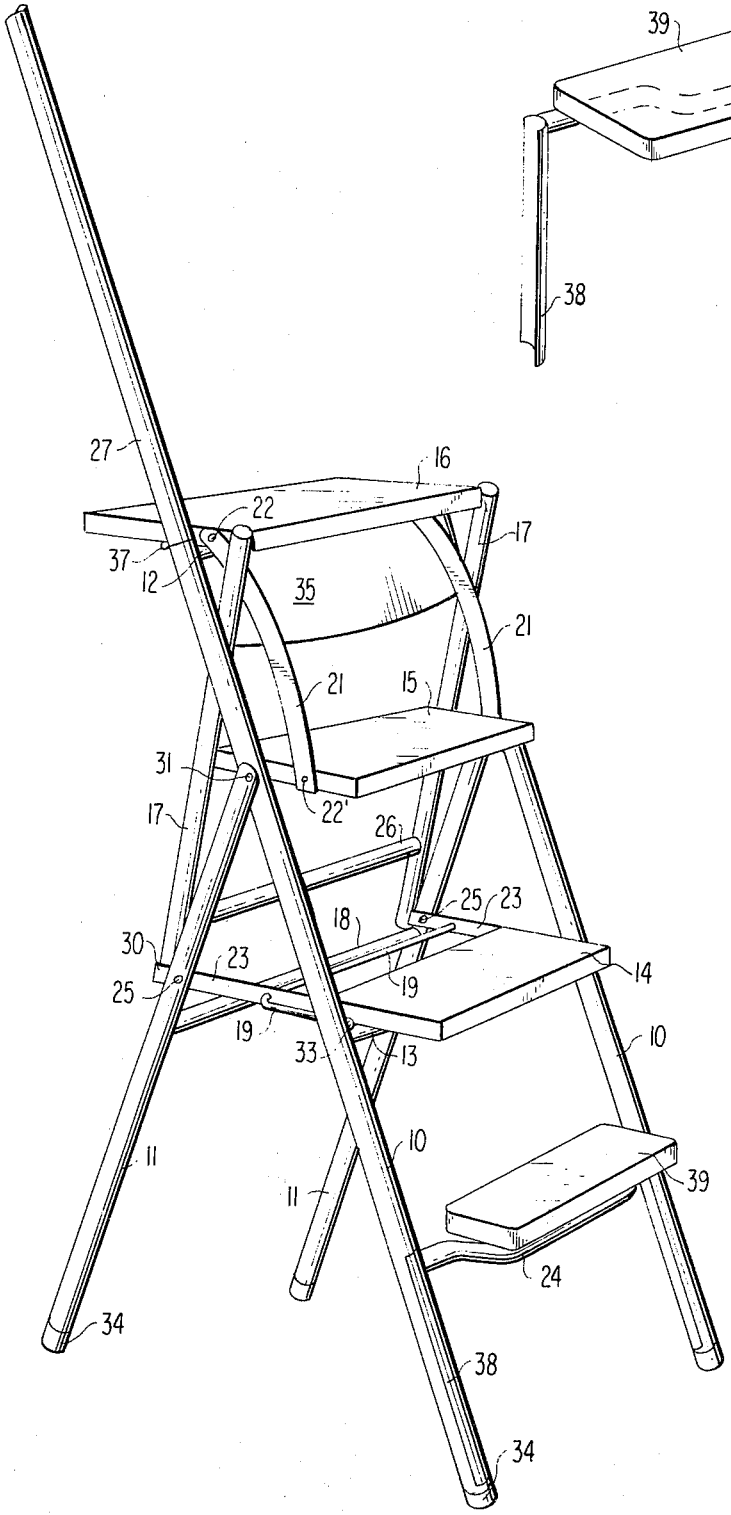
FIG. 3. is a perspective view of the structure of the invention set up in the position of use as a ladder.

With reference to the drawings the structure comprises, two side poles 10, which in the unfolded structure to be used either as chair or ladder function as the front legs of the furniture (FIGS. 1, 2 and 3). A top transverse arcuate member 12, with its bend directed backward, is fixedly joined, such as by welding, between poles 10, and a straight cross member 13 (FIGS. 1 and 5) likewise rigidly joins the poles 10 at opposed points located below the plane that the chair seat board will occupy. Each of a pair of straight parallel spaced apart legs 11 (FIGS. 1, 2 and 3) are pivoted at their upper ends to each of the poles on pivot points 31 located considerably above the seat plane. The legs 11, in the structure unfolded position to be used as either a chair (FIGS. 1 and 2) or ladder (FIG. 3) operate as the rear legs, angularly directed in respect to the poles 10. The legs 11 are fixedly joined together by means of a transverse straight member 18 (FIGS. 1 and 3) located just beneath the chair seat plane.

The central transverse member 13 (FIGS. 1 and 3) joining the poles 10, offers a bearing means for an intermediate rectangular board 14 (FIGS. 1 and 3) which is swingingly linked, through side arms 23 (FIGS. 1, 2 and 3), to the legs 11 by means of pivot pins 25. The pivot pins 25 (FIGS. 1, 2 and 3) are located at faced points on the legs 11 in a plane just beneath the underside the plane that the chair seat board will adopt. The side arms 23, linking the intermediate board 14 to legs 11, are articulated together by means of the bond bar or fitting member 19 which is a substantially "U" shaped circular cross-section bar having the end portions of its side legs turned outwardly to be journaled thereby into the sockets 33 (FIGS. 1 and 2) which are welded or otherwise unremovably attached to and toward the ends of the transverse member 13, connecting the intermediate region of poles 10. With this arrangement, the pair of side arms 23 and the U fitting member 19 joining the same on points located behind the rear edge of the intermediate board 14, when hand lifting said board 14 from its position bearing on the transverse member 13, the arms 23 swing around the pivot pins 25 placed facing together on the legs 11, and the U fitting member 19 then will act on the transverse member 13 rigidly joining the pair of poles 10, whereby the legs 11 and the poles 10 will be neared each other, toward folded position of the structure.

Two elongated members 17, arranged slightly spaced apart along the side edges of the seat board, when the structure is unfolded to be used as a chair (FIG. 1), are provided at their rear ends with lugs 30 (FIG. 3) by means of which they are pivot joined to the same pivot pins 25 placed on the rear legs 11, the pivot pins 25 thus serving as common means for pivot joining the rear ends, of both arms 23 and elongated members 17, to the legs 11. A cross member 26 rigidly connects together the pair of elongated members 17, at right angles at points located toward the rear end portion thereof.

Figure 4:
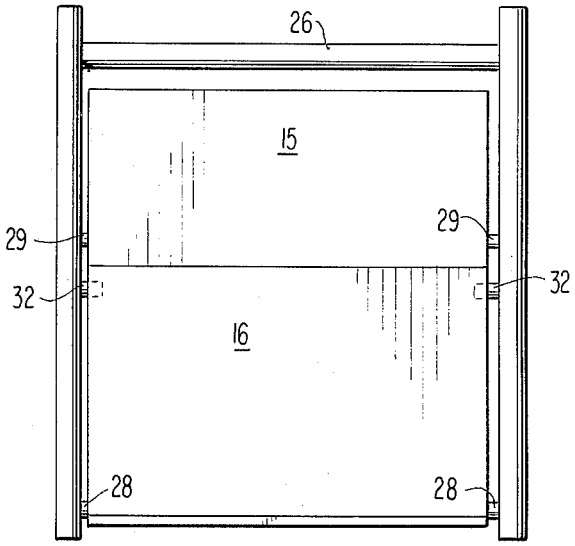
FIG. 4. is a top plan view of the seat zone of the chair, when so used.

At opposed points located toward their front end portions the elongated members 11 are provided with pivot connecting means 28 (FIG. 4) for joining therearound respective side edges of the front end region of a first section of board 16, the width of which preferably is slightly greater than one half the longitudinal dimension of the plane that will serve as chair seat, when the structure is unfolded to be used in such a way. Likewise, at opposed points located rearwardly from the intermediate portion of said elongated members 17 there are arranged the pivot connecting means 29 (FIG. 4) to swingably join therearound respective side edges of the front end region of a second section of board 15 the width thereof preferably being slightly greater than one half the longitudinal dimension of the chair seat plane (FIGS. 1 and 4). The aforecited pivot connecting means 28 and 29 (FIGS. 4 and 5) may be comprised of rigid cross rods with their ends being joined to elongated members 17, 17 or otherwise they may be pivot pins located at the indicated places. Flat articulating members 21, 21 (FIGS. 2, 3 and 5) ) arranged with their planes in vertical planes, one to each side, articulate together the side edges of the board sections 15 and 16. Such articulating members 21, 21 suitably are comprised of simmetrical arcuated flanges with their bends downwardly directed when the board sections 15 and 16 are brought to the horizontal plane (FIG. 2); the articulation members 21, 21 have their ends pivot joined to the boards 15 and 16 respectively at points 22' and 22 (FIG. 3) located at the front side edges of the first board section 16, and at the rear side edges of the second board section 15.

With such arrangement, if the structure has been unfolded toward the position of use as a chair as shown in FIG. 1, then when the first board section 16 is manually raised from its position born against the intermediate board or bearing board 14, it swings around its pivot joint means 28 (FIGS. 4 and 5), and the second board section 15 will swing to be carried by the articulation members 21 till assuming a position in a plane located below the first board section 16.

In the position of the structure to be used as a chair, the first board section 16 supports its rear marginal edge on the edge of the intermediate board 14 and said section 16 is further prevented from turning downward because of the presence of stop elements 32 (FIG. 4) inwardly extended from each of the elongated members 17 to which they are fixedly joined.

In the lower portion of poles 10 there is arranged a lower board 39 which is rigidly joined by any suitable means such as by screws, on a rigid member 24 (FIGS. 1, 2, 3, and 6) which has sections arranged in the same plane to afford enough supporting surface. The ends of the member 24 are joined to straight channeled members 38 having cross-section shape and size suitable to be tightly and slidingly assembled to the lower end lenghts of the poles 10. The slidingly engageable lower board 39 is normally prevented from sliding downwardly along the poles 10 by the stops 34 placed at the lower ends or supporting ends of the poles 10. Similar bearing elements 34 are also arranged at the bottom ends of the rear legs of the structure.

In the structure folded condition, the pair of poles 10 and the pair of legs 11 are in proximity each other; and the swingable elongated members 17 with their boards 16 and 17 pivotally associated therebetween are retracted against the poles 10. In this condition the board herein referred to as the intermediate board 14 will be also retracted backwards together with its fitting member 19 and supporting arms 23. From such folded condition the structure may be then unfolded by turning forwardly said "intermediate" board 14, whereby the pair of poles will be angularly spaced apart away from the pair of legs 11 turning around the connecting pivot pins 31 and at the end of the movement the intermediate board 14 will be borne against the transverse member 13 fixedly connecting the poles 10. In this movement of the board 14, the arms 23 supporting the same will turn around their pivot pins 25 connecting the same to the legs 11 whereby the U shaped fitting member 19,—the cross leg of which rotably extends through the legs 23 and having the end portions of its side legs turned outwardly and rotably joined to the transverse member 13 by lodging the outwardly turned portions within the sockets 33 (FIG. 3)—will forwardly urge said transverse member 13, up to the extent in which the board 14 will be supported thereon. Thereafter the elongated members 17 with the board sections 15 and 16 associated therebetween are turned forwardly, turning around the common pivot pins 25 by means of which they are pivotally connected to the rear legs 11, until the extent at which the assemble of boards 15 and 16 will be supported on the upper face of the intermediate board 14, which previously had been extended to its forward position, bearing on the transverse member 13, as previously stated. In this manner the foldable structure of the invention will have been unfolded to the position of use as a chair, as shown in FIG. 1. The top transverse member 12 is rearwardly arcuated and holds the similarly arcuated panel 35 (FIGS. 1 and 2) suitable for serving as chair seat back.

From the chair position shown in FIG. 1 the structure of the invention can be changed into the ladder structure as shown in FIG. 3. For this purpose the first board section 16 is hand turned upward which will cause the side articulation flanges 21 to swing around their pivot connecting points 22 and 22', respectively located at the side edges of boards 16 and 15, so that the second board section 15 will swing to be brough to assume a plane below the plane of the first board section 16, while the side elongated members 17 will turn around their pivot pins 25 for thus raising rearward the board section 16 placing the same on an upper horizontal plane, in position supported on the top transverse member 12. In this condition, the second board section 15 will have assumed a correspondingly horizontal position in a plane below and forwardly in respect of the board section 16. Stop pegs (not shown) downwardly projecting from the underside front marginal zone of the first board section 16, prevent the board 16 from sliding rearward on the transverse top member 12, whereas the second board section 15 is firmly held, through the articulation flanges 21 (FIG. 3) from the upper board 16 which is now fixed in horizontal position, impeded from sliding rearward, because of the arrangement of said stop pegs on the underside of board 16.

Therefore there is provided a fourtread ladder structure, easily and quickly changeable into chair and viceversa, or into a folded structure for storage.

As previously stated the foldable structure of the invention desirably is constructed in its major part from metal tubular stock. Within one of the tubular poles 10 it is telescopically lodged a straight member 27 which, when extended, affords a means of hand bearing or ladder handrail. The rod 27 is provided near its lower end with spring biased stop means 37 which, when extending the handrail 27 impedes its return into the interior of pole 10 wherein it was lodged, and so the rod 27 is maintained in extended position, until when the retractable stop member 37 is voluntarily depressed for retracting the rod 27 into its housing.

From the foregoing description it will be noted that the invention provides a foldable structure that may be unfolded to position of use as either chair or ladder. It will be noted also that changes, modifications, additions and supressions can be made into the here disclosed structure without changing the spirit of the invention, the scope thereof being defined by the following claims.

What I claim is:

1. Furniture foldable structure, unfoldable to provide either a chair having a seat or ladder structure, which foldable structure comprises the combination of, a pair of side straight spaced parallel poles, said poles being rigidly connected together by a first top transverse member and by a second intermediate transverse member; a pair of straight spaced parallel legs the top ends of which are pivot connected at opposed points of said pair of poles, said opposed points being located between the points where said first and second transverse members are joined to said pair of poles, said pair of parallel legs being rigidly connected together by a transverse member located just beneath underside of the said seat when said foldable structure is unfolded as a chair;

a pair of side arms laterally and swingingly arranged between both said pair of poles and said pair of legs with each of said side arms having their rear ends pivotally joined to each of said legs on opposed points thereof located at a plane just beneath the underside of the said seat when said foldable structure is unfolded as a chair, the front end of said pair of side arms rigidly embracing therebetween the side edges of a rectangular board, said pair of side arms being articulated together by a fitting member oscillably linking the same to said second transverse member so that when said pair of side arms together with its board rigidly associated therebetween is turned around their pivot connecting means, the movement is applied to move near or away said pair of poles toward or from said pair of legs;

a pair of parallel elongated side members laterally and swingingly arranged between both said pair of poles and said pair of legs with each of said elongated members having their rear ends pivotally connected to each of said legs on opposed points thereof, said parallel elongated members being rigidly connected together toward their rear end by a cross member, said elongated members being provided at their intermediate portion with inwardly extended stop lugs;

a said seat comprising first rectangular board section being pivotally joined between the front length of said pair of elongated members by opposed pivot connecting means located toward the front side edges of said first board section, and a second rectangular board section, with its front edge arranged in proximity to the rear edge of said first board section, being pivotally joined between the rear length of said pair of elongated members by opposed connecting means located toward the front side edges of said second board section;

rigid articulating means swingingly linking the side edges of said first and second board sections at opposed points toward the front end edges of said first board section and at opposed points toward the rear end edges of said second board; and a lower horizontal board removably arranged on the lower length of said pair of poles, slidingly engaged thereto by channeled assembling means.

2. Furniture foldable structure according to claim 1, wherein said opposed points on which said pair of side arms are pivotally joined to said legs are common pivot pins connecting also thereto rear ends of said pair of parallel elongated side members through perforated lugs extended from said rear ends of said pair of elongated members.

3. Furniture foldable structure according to claim 1, wherein said first top transverse member rigidly connecting said pair of poles is arcuated backward on a substantially horizontal plane against the rear edge of which engages at least one stop peg extended from the underside of said first rectangular board section.

4. Furniture foldable structure according to claim 1, wherein said fitting member rotably linking said pair of side arms to said second transverse member is comprised of a substantially "U" shaped circular cross-sectional bar the transverse leg of which freely extends through opposed openings arranged in each of said pair of arms behind the rear edge of said rectangular board rigidly embraced therebetween, and the side legs of which have their end portions turned outwardly, said turned outwardly portions being journaled within sockets fixedly attached toward the ends of said second transverse member rigidly connecting the intermediate portions of said pair of poles.

5. Furniture foldable structure according to claim 1, wherein said rectangular board rigidly associated between said pair of swinging arms acts as a bearing plane for said first and second board sections when said foldable structure is unfolded to chair position, and when said foldable structure is brought to ladder condition said board rigidly associated between said pair of swinging arms operates as a ladder tread.

6. Furniture foldable structure according to claim 1, wherein at least one pole of said pair of poles telescopically lodges therein an elongated member which is extendable as a ladder handrail, said elongated member being provided at is lower end with stop means which operates to maintain the same in extended position.

* * * * *